US011067029B2

(12) United States Patent
Barnes et al.

(10) Patent No.: US 11,067,029 B2
(45) Date of Patent: Jul. 20, 2021

(54) SYSTEMS AND METHODS FOR COUPLING A CYLINDER HEAD TO A CYLINDER BLOCK

(71) Applicant: CUMMINS INC., Columbus, IN (US)

(72) Inventors: David M. Barnes, Columbus, IN (US); David J. Eckroth, Columbus, IN (US)

(73) Assignee: Cummins Inc., Columbus, IN (US)

( * ) Notice: Subject to any disclaimer, the term of this patent is extended or adjusted under 35 U.S.C. 154(b) by 233 days.

(21) Appl. No.: 16/050,596

(22) Filed: Jul. 31, 2018

(65) Prior Publication Data

US 2020/0040839 A1 Feb. 6, 2020

(51) Int. Cl.

| | |
|---|---|
| ***F02F 1/10*** | (2006.01) |
| ***F02F 7/00*** | (2006.01) |
| ***F02F 1/42*** | (2006.01) |
| ***F02F 11/00*** | (2006.01) |

(52) U.S. Cl.

CPC ..... *F02F 1/102* (2013.01); *F02F 1/42* (2013.01); *F02F 7/0021* (2013.01); *F02F 11/002* (2013.01); *F02F 2007/0063* (2013.01)

(58) Field of Classification Search

CPC .. F02F 1/102; F02F 1/42; F02F 7/0021; F02F 11/002; F02F 2007/0063

See application file for complete search history.

(56) References Cited

U.S. PATENT DOCUMENTS

| | | | | |
|---|---|---|---|---|
| 2,127,825 A * | 8/1938 | Mader | F02F 1/186 | 123/41.74 |
| 3,304,134 A | 2/1967 | Allen | | |
| 5,404,847 A | 4/1995 | Han | | |
| 5,727,512 A * | 3/1998 | Hutchins | F01M 11/02 | 123/193.3 |
| 5,868,107 A * | 2/1999 | Betsch | F02F 1/40 | 123/195 R |

(Continued)

FOREIGN PATENT DOCUMENTS

| | | |
|---|---|---|
| DE | 19604547 | 8/1996 |
| JP | 0 242 120 A2 | 10/1987 |

(Continued)

OTHER PUBLICATIONS

International Search Report and Written Opinion from corresponding PCT Application No. PCT/US2019/013435, dated Mar. 18, 2019, pp. 1-12.

*Primary Examiner* — Kevin A Lathers
(74) *Attorney, Agent, or Firm* — Foley & Lardner LLP

(57) ABSTRACT

An internal combustion engine includes a cylinder head and a cylinder block. The cylinder head includes a first boss cylinder head conduit portion and a first boss cylinder head cavity portion. The first boss cylinder head conduit portion is configured to receive a first fastener without threadably engaging the first fastener. The first boss cylinder head conduit portion has a first diameter. The first boss cylinder head cavity portion is aligned with the first boss cylinder head conduit portion. The first boss cylinder head cavity portion is configured to receive the first fastener without threadably engaging the first fastener. The first boss cylinder head cavity portion has a second diameter greater than the first diameter. The cylinder block is coupled to the cylinder head. The cylinder block includes a first boss cylinder block threaded portion.

27 Claims, 4 Drawing Sheets

(56) References Cited

U.S. PATENT DOCUMENTS

| | | | |
|---|---|---|---|
| 6,283,081 | B1 | 9/2001 | Ozeki |
| 6,532,929 | B2 | 3/2003 | Antonevich et al. |
| 7,520,256 | B2 | 4/2009 | Omura et al. |
| 2016/0265475 | A1 | 9/2016 | Havran et al. |

FOREIGN PATENT DOCUMENTS

| | | | |
|---|---|---|---|
| JP | 2006-138226 | A | 6/2006 |
| JP | 4552832 | B2 | 9/2010 |

* cited by examiner

SYSTEMS AND METHODS FOR COUPLING A CYLINDER HEAD TO A CYLINDER BLOCK

TECHNICAL FIELD

The present application relates generally to systems and methods for coupling a cylinder head of an internal combustion engine to a cylinder block of the internal combustion engine.

BACKGROUND

Internal combustion engines typically include a cylinder head and a cylinder block. The cylinder head may be attached to the cylinder block through the use of fasteners. Such internal combustion engines include pistons positioned within the cylinder block. These pistons are used to convert chemical energy from fuel into mechanical energy (e.g., at a crankshaft, etc.).

SUMMARY

In one embodiment, an internal combustion engine includes a cylinder head and a cylinder block. The cylinder head includes a first boss cylinder head conduit portion and a first boss cylinder head cavity portion. The first boss cylinder head conduit portion is configured to receive a first fastener without threadably engaging the first fastener. The first boss cylinder head conduit portion has a first diameter. The first boss cylinder head cavity portion is aligned with the first boss cylinder head conduit portion. The first boss cylinder head cavity portion is configured to receive the first fastener without threadably engaging the first fastener. The first boss cylinder head cavity portion has a second diameter greater than the first diameter. The cylinder block is coupled to the cylinder head. The cylinder block includes a first boss cylinder block threaded portion. The first boss cylinder block threaded portion is aligned with the first boss cylinder head conduit portion. The first boss cylinder block threaded portion is configured to threadably engage the first fastener.

In another embodiment, an internal combustion engine includes a cylinder head, a cylinder block, and a first fastener. The cylinder head includes a first boss cylinder head conduit portion and a first boss cylinder head cavity portion. The first boss cylinder head conduit portion is centered on a first boss axis. The first boss cylinder head conduit portion is separated from the first boss axis by a first spacing. The first boss cylinder head cavity portion is aligned with the first boss cylinder head conduit portion. The first boss cylinder head cavity portion is separated from the first boss axis by a second spacing greater than the first spacing. The cylinder block is coupled to the cylinder head. The cylinder block includes a first boss cylinder block cavity portion and a first boss cylinder block threaded portion. The first boss cylinder block cavity portion is aligned with the first boss cylinder head conduit portion. The first boss cylinder block cavity portion is separated from the first boss axis by the second spacing. The first boss cylinder block threaded portion is aligned with the first boss cylinder head conduit portion. The first boss cylinder block threaded portion is separated from the first boss axis by a third spacing less than the second spacing. The first fastener is received within the first boss cylinder head conduit portion, the first boss cylinder head cavity portion, the first boss cylinder block cavity portion, and the first boss cylinder block threaded portion. The first fastener engages the first boss cylinder block threaded portion. The first fastener does not engage the first boss cylinder head conduit portion, the first boss cylinder head cavity portion, or the first boss cylinder block cavity portion.

In yet another embodiment, an internal combustion engine includes a cylinder head and a cylinder block. The cylinder head includes a first boss cylinder head conduit portion, a first boss cylinder head cavity portion, a second boss cylinder head conduit portion, and a second boss cylinder head cavity portion. The first boss cylinder head conduit portion is configured to receive a first fastener without threadably engaging the first fastener. The first boss cylinder head conduit portion is centered on a first boss axis and separated from the first boss axis by a first spacing. The first boss cylinder head cavity portion is aligned with the first boss cylinder head conduit portion. The first boss cylinder head cavity portion is configured to receive the first fastener without threadably engaging the first fastener. The first boss cylinder head cavity portion is separated from the first boss axis by a second spacing greater than the first spacing. The second boss cylinder head conduit portion is configured to receive a second fastener without threadably engaging the second fastener. The second boss cylinder head conduit portion is centered on a second boss axis and separated from the second boss axis by a third spacing. The second boss cylinder head cavity portion is aligned with the second boss cylinder head conduit portion. The second boss cylinder head cavity portion is configured to receive the second fastener without threadably engaging the second fastener. The second boss cylinder head cavity portion is separated from the second boss axis by a fourth spacing greater than the third spacing. The cylinder block is coupled to the cylinder head. The cylinder block includes a first boss cylinder block cavity portion, a first boss cylinder block threaded portion, a second boss cylinder block cavity portion, and a second boss cylinder block threaded portion. The first boss cylinder block cavity portion is aligned with the first boss cylinder head conduit portion. The first boss cylinder block cavity portion is configured to receive the first fastener without threadably engaging the first fastener. The first boss cylinder block cavity portion is separated from the first boss axis by the second spacing. The first boss cylinder block threaded portion is aligned with the first boss cylinder head conduit portion. The first boss cylinder block threaded portion is configured to receive and threadably engage the first fastener. The first boss cylinder block threaded portion is separated from the first boss axis by a fifth spacing less than the second spacing. The second boss cylinder block cavity portion is aligned with the second boss cylinder head conduit portion. The second boss cylinder block cavity portion is configured to receive the second fastener without threadably engaging the second fastener. The second boss cylinder block cavity portion is separated from the second boss axis by the fourth spacing. The second boss cylinder block threaded portion is aligned with the second boss cylinder head conduit portion. The second boss cylinder block threaded portion is configured to receive and threadably engage the second fastener. The second boss cylinder block threaded portion is separated from the second boss axis by a sixth spacing less than the fourth spacing. A cylinder head-block interface is defined between the cylinder head and the cylinder block. The first boss cylinder head cavity portion is contiguous with the cylinder head-block interface. The first boss cylinder block cavity portion is contiguous with the cylinder head-block interface.

In yet another embodiment, a cylinder head includes a first boss cylinder head conduit portion and a first boss cylinder head cavity portion. The first boss cylinder head conduit portion is configured to receive a first fastener without threadably engaging the first fastener. The first boss cylinder head conduit portion is configured to maintain a first spacing from the first fastener when the first fastener is received in the first boss cylinder head conduit portion. The first boss cylinder head cavity portion is aligned with the first boss cylinder head conduit portion and configured to receive the first fastener without threadably engaging the first fastener. The first boss cylinder head cavity portion is configured to maintain a second spacing from the first fastener when the first fastener is received in the first boss cylinder head cavity portion. The second spacing is greater than the first spacing.

In yet another embodiment, a cylinder block includes a first boss cylinder block threaded portion and a first boss cylinder block cavity portion. The first boss cylinder block threaded portion is configured to receive and threadably engage a first fastener. The first boss cylinder block cavity portion is aligned with the first boss cylinder block threaded portion and configured to receive the first fastener without threadably engaging the first fastener. The first boss cylinder block cavity portion is contiguous with a cylinder head-block interface from which the first fastener is configured to protrude when the first fastener is received in the first boss cylinder block threaded portion.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

Figure 1:
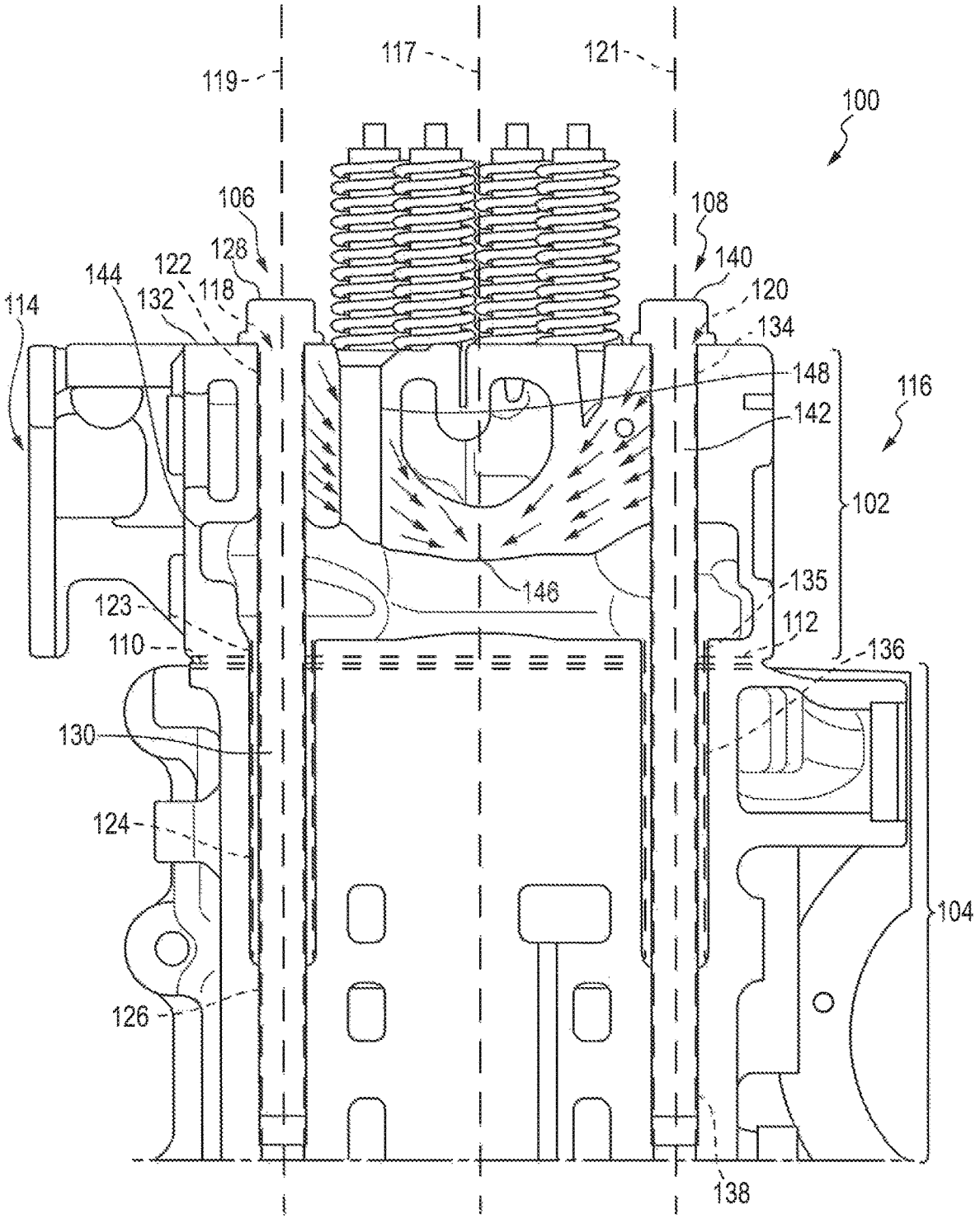
FIG. 1 is a cross-sectional view of a portion of an internal combustion engine according to an example embodiment.

It will be recognized that some or all of the figures are schematic representations for purposes of illustration. The figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and systems for coupling a cylinder head of an internal combustion engine to a cylinder block of the internal combustion engine. The various concepts introduced above and discussed in greater detail below may be implemented in any of numerous ways, as the described concepts are not limited to any particular manner of implementation. Examples of specific implementations and applications are provided primarily for illustrative purposes.

I. Overview

An internal combustion engine includes a cylinder head and a cylinder block. The cylinder head is attached to the cylinder block through the use of fasteners. Stresses accumulate within the cylinder head and cylinder block, such as at the fasteners used to attach the cylinder head to the cylinder block, during operation of the internal combustion engine. These stresses can cause the internal combustion engine to become undesirable.

An internal combustion engine may include a gasket positioned between the cylinder head and the cylinder block. The fasteners which secure the cylinder head to the cylinder block may compress the gasket between the cylinder head and the cylinder block. When stresses accumulate within an internal combustion engine, compression of the gasket may be applied inconsistently, thereby causing the internal combustion engine to become undesirable.

Implementations herein are directed to an internal combustion engine which includes a boss extending through the cylinder head and the cylinder block and having portions with a first diameter for engaging with a fastener coupling the cylinder head to the cylinder block and other portions with a second diameter, larger than the first diameter, and for isolating the boss from the fastener (e.g., such that the fastener does not threadably engage with the boss, etc.) The boss is configured such that these isolating portions are contiguous with an interface between the cylinder head and cylinder block. In this way, a load path of the pressure from the fastener cannot be directly transmitted along the fastener from the cylinder head to the cylinder block, and is instead directed towards a focal point. As a result of avoiding the direct transfer of pressure along the fastener, the pressure applied to a gasket between the cylinder head and the cylinder block is more consistent than in internal combustion engines without such a boss, thereby causing the internal combustion engine described herein to be more desirable.

II. Example Cylinder Head and Cylinder Block

FIGS. 1-4 variously depict portions of an internal combustion engine 100. The internal combustion engine 100 is configured to utilize chemical energy from fuel to produce mechanical energy. Specifically, the internal combustion engine 100 combusts (e.g., burns, etc.) fuel through a combustion process which occurs within at least one cylinder (e.g., combustion chamber, etc.) of the internal combustion engine 100.

The internal combustion engine 100 includes a piston positioned within each of the at least one cylinder. The internal combustion engine 100 may include any number of cylinders and any number of pistons. For example, the internal combustion engine 100 may include one, two, three, four, five, six, seven, eight, nine, ten, twelve, or more cylinders and an equal number of pistons. Each piston is configured to move within the associated cylinder. In this way, each piston may be connected to an output of the internal combustion engine 100 to produce mechanical energy (e.g., via connecting rods and a crankshaft, etc.).

In various embodiments, the internal combustion engine 100 consumes diesel fuel and is a diesel internal combustion engine. In other embodiments, the internal combustion engine 100 consumes gasoline (e.g., petrol, etc.) and is a gasoline internal combustion engine. In other applications, the internal combustion engine 100 consumes natural gas (e.g., liquid natural gas, compressed natural gas (CNG), etc.), biofuel (e.g., biomass, etc.) ethanol (e.g., E-85, etc.), and other similar fuels. In still other embodiments, the internal combustion engine 100 is a dual-fuel internal combustion engine and consumes two different fuels (e.g., diesel and gasoline, diesel and ethanol, gasoline and ethanol, natural gas and diesel, etc.).

The internal combustion engine 100 includes a cylinder head 102 and a cylinder block 104. The aforementioned pistons and cylinders are variously positioned within the cylinder block 104. The cylinder head 102 is coupled to the cylinder block 104 using a plurality of fasteners including a first fastener 106 and a second fastener 108. As will be explained in more detail herein, the first fastener 106 and the second fastener 108 threadably engage only the cylinder block 104, and not the cylinder head 102, such that the cylinder head 102 is held against the cylinder block 104. While the internal combustion engine 100 is only shown and described as including the first fastener 106 and the second fastener 108, it is understood that the internal combustion engine 100 may include any number of fasteners like the first fastener 106 and the second fastener 108 shown and described herein.

The cylinder head 102 interfaces with the cylinder block 104 along a cylinder head-block interface 110. In various embodiments, the cylinder head-block interface 110 is disposed along a plane. For example, the cylinder head-block interface 110 may be disposed along a horizontal plane (e.g., a plane which is parallel to the horizontal, a plane which is parallel to a ground surface, etc.).

The internal combustion engine 100 includes a gasket 112 (e.g., head gasket, seal, etc.). The gasket 112 is disposed along the cylinder head-block interface 110 and separates at least a portion of the cylinder head 102 from at least a portion of the cylinder block 104. In some embodiments, the gasket 112 is disposed along the cylinder head-block interface 110 to entirely separate the cylinder head 102 from the cylinder block 104. The gasket 112 may include a plurality of rings, each of the rings being configured to be disposed around a cylinder of the internal combustion engine 100. The gasket 112 may be constructed from, for example, composite material (e.g., graphite, etc.), ceramics, metals (e.g., aluminum, copper, titanium, stainless steel, multi-layered steel, etc.), Viton, and other similar materials.

The cylinder head 102 is defined by a first side 114 (e.g., a hot side, a cold side, exhaust side, intake side, etc.) and a second side 116 (e.g., a cold side, a hot side, intake side, exhaust side, etc.). The first side 114 is opposite the second side 116. The cylinder head 102 is configured such that the first fastener 106 is configured to be disposed within the cylinder head 102 proximate the first side 114 and the second fastener 108 is configured to be disposed within the cylinder head 102 proximate the second side 116.

The internal combustion engine 100 includes a first boss 118 (e.g., hole, aperture, multi-diameter hole, bore, etc). The first boss 118 is centered on a first boss axis 119 (e.g., center axis, etc.). The internal combustion engine 100 also includes a second boss 120 (e.g., hole, aperture, multi-diameter hole, bore, etc.). The internal combustion engine 100 includes one or more first bosses 118 and one or more second bosses 120 along a length of the cylinder head 102. For example, the internal combustion engine 100 may include four first bosses 118 and four second bosses 120. In another example, the internal combustion engine 100 may include ten first bosses 118 and nine second bosses 120.

The second boss 120 is centered on a second boss axis 121 (e.g., center axis, etc.). The first boss axis 119 is parallel to the second boss axis 121. In various embodiments, the first boss 118 and the second boss 120 are configured such that the first boss axis 119 and the second boss axis 121 are substantially equidistant from a cylinder head-block axis 117 (e.g., a difference between a first distance between the first boss axis 119 and the cylinder head-block axis 117 and a second distance between the second boss axis 121 and the cylinder head-block axis 117 is less than or equal to 5%, a difference between a first distance between the first boss axis 119 and the cylinder head-block axis 117 and a second distance between the second boss axis 121 and the cylinder head-block axis 117 is less than or equal to 3%, etc.). In other embodiments, the first boss 118 and the second boss 120 are configured such that the first boss axis 119 and the second boss axis 121 are not equidistant from the cylinder head-block axis 117 (e.g., the first boss axis 119 is closer to the cylinder head-block axis 117 than the second boss axis 121, the second boss axis 121 is closer to the cylinder head-block axis 117 than the first boss axis 119, etc.). In these ways, the cylinder head 102 and the cylinder block 104 may be substantially symmetrical about the cylinder head-block axis 117 (e.g., about a plane extending along the cylinder head 102 and cylinder block 104 that is coincident with the cylinder head-block axis 117, etc.) or non-symmetrical about the cylinder head-block axis 117 (e.g., about a plane extending along the cylinder head 102 and cylinder block 104 that is coincident with the cylinder head-block axis 117, etc.).

The first boss 118 and the second boss 120 each extend through the cylinder head 102 and into the cylinder block 104. The first boss 118 is configured to receive the first fastener 106 and to facilitate threaded engagement between the first fastener 106 and only the cylinder block 104, and not the cylinder head 102. Similarly, the second boss 120 is configured to receive the second fastener 108 and to facilitate threaded engagement between the second fastener 108 and only the cylinder block 104, and not the cylinder head 102.

The first boss 118 includes a first boss cylinder head conduit portion 122 and a first boss cylinder head cavity portion 123. The first boss cylinder head conduit portion 122 and the first boss cylinder head cavity portion 123 are positioned within the cylinder head 102. The first boss cylinder head conduit portion 122 is defined by a first diameter, and the first boss cylinder head cavity portion 123 is defined by a second diameter greater than the first diameter. The second diameter may be a spacing (e.g., a distance between the first fastener 106 and the first boss cylinder head cavity portion 123, etc.)—rather than a diameter where the first boss cylinder head cavity portion 123 is ovoid or non-circular (e.g., diamond shaped, arcuate, square, pentagonal, hexagonal, polygonal, etc.).

The first boss cylinder head conduit portion 122 and the first boss cylinder head cavity portion 123 each define through-holes (e.g., are not threaded holes, etc.). Neither the first boss cylinder head conduit portion 122 nor the first boss cylinder head cavity portion 123 threadably engages the first fastener 106 (e.g., the first fastener 106 does not thread into the first boss cylinder head conduit portion 122 or the first boss cylinder head cavity portion 123, etc.). Due to the difference in diameter or spacing of the first boss cylinder head conduit portion 122 and the first boss cylinder head cavity portion 123, a gap between the first fastener 106 and the first boss cylinder head cavity portion 123 is larger than a gap between the first fastener 106 and the first boss cylinder head conduit portion 122.

The first boss 118 also includes a first boss cylinder block cavity portion 124 and a first boss cylinder block threaded portion 126. The first boss cylinder block cavity portion 124 and the first boss cylinder block threaded portion 126 are positioned within the cylinder block 104. The first boss cylinder block cavity portion 124 is aligned and coextensive with the first boss cylinder head cavity portion 123. Specifically, the first boss cylinder block cavity portion 124 has the same diameter or spacing as the first boss cylinder head cavity portion 123 (e.g., the second diameter, etc.) along at least one plane coincident with the first boss axis 119. The first boss cylinder block cavity portion 124 is configured to not engage the first fastener 106. The first boss cylinder block threaded portion 126 is configured to threadably engage the first fastener 106. The first boss cylinder block threaded portion 126 is defined by a third diameter. The third diameter is less than the second diameter (e.g., the diameter of the first boss cylinder block cavity portion 124, the diameter of the first boss cylinder head cavity portion 123, etc.). The third diameter is less than the first diameter (e.g., the diameter of the first boss cylinder head conduit portion 122, etc.).

The first fastener 106 includes a first fastener head 128 and a first fastener body 130. The first fastener head 128 may be, for example, a hex head, a Phillips head, a regular head (e.g., to receive a regular screwdriver, etc.), a Torx head (e.g., an external Torx head, an internal Torx head, a security Torx head, etc.), an Allen head, and other similar fastener heads. The first fastener body 130 is at least partially threaded. For example, the first fastener body 130 may be fully threaded or may include portions (e.g., a middle portion, a central portion, etc.) which are not threaded. In various embodiments, the first fastener head 128 is flanged. However, in other embodiments, the first fastener head 128 is not flanged. Various washers may be utilized to separate the first fastener head 128 from the cylinder head 102 such that the internal combustion engine 100 is tailored for a target application.

The cylinder head 102 is coupled to the cylinder block 104 by inserting the first fastener body 130 into the first boss cylinder head conduit portion 122, inserting the first fastener body 130 into the first boss cylinder head cavity portion 123, inserting the first fastener body 130 into the first boss cylinder block cavity portion 124, and threading the first fastener body 130 into the first boss cylinder block threaded portion 126 such that the first fastener head 128 contacts a top surface 132 (e.g., spring deck, etc.) of the cylinder head 102. By threading the first fastener body 130 into the first boss cylinder block threaded portion 126, the first fastener body 130 is drawn through the first boss cylinder head conduit portion 122, the first boss cylinder head cavity portion 123, and the first boss cylinder block cavity portion 124. The first fastener 106 may then be tightened to a target torque (e.g., one-hundred foot pounds, etc.). A reverse of this process is implemented for removing the first fastener 106 from the first boss 118 and thereby at least partially uncoupling (e.g., detaching, removing, etc.) the cylinder head 102 from the cylinder block 104.

The first boss cylinder head cavity portion 123 and the first boss cylinder block cavity portion 124, which are separated by the cylinder head-block interface 110, provide separation between the first fastener body 130 and the cylinder head 102 and the cylinder block 104 such that the first fastener 106 does not bear upon the cylinder head 102 or the cylinder block 104 proximate the cylinder head-block interface 110. As will be described in more detail herein, this arrangement directs a load path of the pressure from the first fastener 106 towards a focal point rather than along the first fastener 106 from the cylinder head 102 to the cylinder block 104. In various embodiments, the first boss cylinder head cavity portion 123 and the first boss cylinder block cavity portion 124 are cylindrical. In these embodiments, each of the first boss cylinder head cavity portion 123 and the first boss cylinder block cavity portion 124 may have a diameter or spacing greater than a diameter of the first fastener body 130. In some of these embodiments, the diameter or spacing of the first boss cylinder head cavity portion 123 is equal to the diameter or spacing of the first boss cylinder block cavity portion 124.

The second boss 120 includes a second boss cylinder head conduit portion 134 and a second boss cylinder head cavity portion 135. The second boss cylinder head conduit portion 134 and the second boss cylinder head cavity portion 135 are positioned within the cylinder head 102. The second boss cylinder head conduit portion 134 is defined by a fourth diameter and the second boss cylinder head cavity portion 135 is defined by a fifth diameter or spacing greater than the fourth diameter. The fifth diameter may be a spacing (e.g., a distance between the second fastener 108 and the second boss cylinder head cavity portion 135, etc.)—rather than a diameter—where the second boss cylinder head cavity portion 135 is ovoid or non-circular.

The second boss cylinder head conduit portion 134 and the second boss cylinder head cavity portion 135 each define through-holes. Neither the second boss cylinder head conduit portion 134 nor the second boss cylinder head cavity portion 135 threadably engages the second fastener 108 (e.g., the second fastener 108 does not thread into the second boss cylinder head conduit portion 134 or the second boss cylinder head cavity portion 135, etc.). Due to the difference in diameter or spacing of the second boss cylinder head conduit portion 134 and the second boss cylinder head cavity portion 135, a gap between the second fastener 108 and the second boss cylinder head cavity portion 135 is larger than a gap between the second fastener 108 and the second boss cylinder head conduit portion 134.

The second boss 120 also includes a second boss cylinder block cavity portion 136 and a second boss cylinder block threaded portion 138. The second boss cylinder block cavity portion 136 and the second boss cylinder block threaded portion 138 are positioned within the cylinder block 104. The second boss cylinder block cavity portion 136 is aligned and coextensive with the second boss cylinder head cavity portion 135. Specifically, the second boss cylinder block cavity portion 136 has the same diameter or spacing as the second boss cylinder head cavity portion 135 (e.g., the fifth diameter, etc.) along at least one plane coincident with the second boss axis 121. The second boss cylinder block cavity portion 136 is configured to not engage the second fastener 108. The second boss cylinder block threaded portion 138 is configured to threadably engage the second fastener 108. The second boss cylinder block threaded portion 138 is defined by a sixth diameter. The sixth diameter is less than the fifth diameter (e.g., the diameter of the second boss cylinder block cavity portion 136, the diameter of the second boss cylinder head cavity portion 135, etc.). The sixth diameter is less than the fourth diameter (e.g., the diameter of the second boss cylinder head conduit portion 134, etc.).

The second fastener 108 includes a second fastener head 140 and a second fastener body 142. The second fastener head 140 may be, for example, a hex head, a Phillips head, a regular head (e.g., to receive a regular screwdriver, etc.), a Torx head (e.g., an external Torx head, an internal Torx head, a security Torx head, etc.), an Allen head, and other similar fastener heads. The second fastener body 142 is at least partially threaded. For example, the second fastener body 142 may be fully threaded or may include portions (e.g., a middle portion, a central portion, etc.) which are not threaded. In various embodiments, the second fastener head 140 is flanged. However, in other embodiments, the second fastener head 140 is not flanged. Various washers may be utilized to separate the second fastener head 140 from the cylinder head 102 such that the internal combustion engine 100 is tailored for a target application.

The cylinder head 102 is coupled to the cylinder block 104 by inserting the second fastener body 142 into the second boss cylinder head conduit portion 134, inserting the second fastener body 142 into the second boss cylinder head cavity portion 135, inserting the second fastener body 142 into the second boss cylinder block cavity portion 136, and threading the second fastener body 142 into the second boss cylinder block threaded portion 138 such that the second fastener head 140 contacts the top surface 132 of the cylinder head 102. By threading the second fastener body 142 into the second boss cylinder block threaded portion 138, the second fastener body 142 is drawn through the second boss cylinder head conduit portion 134, the second boss cylinder head cavity portion 135, and the second boss cylinder block cavity portion 136. The second fastener 108 may then be tightened to a target torque (e.g., one-hundred foot pounds, etc.). A reverse of this process is implemented for removing the second fastener 108 from the second boss 120 and thereby at least partially uncoupling (e.g., detaching, removing, etc.) the cylinder head 102 from the cylinder block 104.

The second boss cylinder head cavity portion 135 and the second boss cylinder block cavity portion 136, which are separated by the cylinder head-block interface 110, provide separation between the second fastener body 142 and the cylinder head 102 and the cylinder block 104 such that the second fastener 108 does not bear upon the cylinder head 102 or the cylinder block 104 proximate the cylinder head-block interface 110. As will be described in more detail herein, this arrangement directs a load path of the pressure from the second fastener 108 towards a focal point rather than along the second fastener 108 from the cylinder head 102 to the cylinder block 104. In various embodiments, the second boss cylinder head cavity portion 135 and the second boss cylinder block cavity portion 136 are cylindrical. In these embodiments, each of the second boss cylinder head cavity portion 135 and the second boss cylinder block cavity portion 136 may have a diameter or spacing greater than a diameter of the second fastener body 142. In some of these embodiments, the diameter or spacing of the second boss cylinder head cavity portion 135 is equal to the diameter or spacing of the second boss cylinder block cavity portion 136.

The first boss cylinder head conduit portion 122 and the second boss cylinder head conduit portion 134 are each contiguous with the top surface 132 whereas the first boss cylinder head cavity portion 123 and the second boss cylinder head cavity portion 135 are not contiguous with the top surface 132 and are instead contiguous with the cylinder head-block interface 110. Accordingly, the diameter or spacing of the first boss 118 and the second boss 120 is lesser proximate the top surface 132 than proximate the cylinder head-block interface 110.

The cylinder head 102 has a greater cross-sectional area (e.g., measured along a plane parallel to the cylinder head-block interface 110, etc.) proximate the top surface 132 than proximate the cylinder head-block interface 110. This greater cross-sectional area of the cylinder head 102 proximate the top surface 132 mitigates local yielding (e.g., deformation, etc.) and/or galling (e.g., wearing, marring, etc.) of the cylinder head 102 (e.g., of the top surface 132, etc.). Furthermore, this greater cross-sectional area of the cylinder head 102 proximate the top surface 132 may minimize or eliminate the need for washers or spacers between the first fastener head 128 and the top surface 132 and between the second fastener head 140 and the top surface 132, thereby reducing the cost and simplifying the manufacturing of the internal combustion engine 100.

The cylinder head 102 also has a lower cross-sectional area proximate the cylinder head-block interface 110 than proximate the top surface 132. This lower cross-sectional area of the cylinder head 102 proximate the cylinder head-block interface 110 decreases a surface area of the cylinder head-block interface 110 and correspondingly increases the pressure applied on the gasket 112 due to the relationship between pressure and surface area for a given force.

The internal combustion engine 100 also includes a main cavity 144. As shown in FIG. 1, the main cavity 144 is coextensive with the first boss cylinder head cavity portion 123, the first boss cylinder block cavity portion 124, the second boss cylinder head cavity portion 135, and the second boss cylinder block cavity portion 136. However, the main cavity 144 may be variously segmented into two or more portions along a length of the cylinder head 102, these portions being fluidly connected by the main cavity 144 at another location along the length of the cylinder head 102. Additionally, when the cylinder head 102 is coupled to the cylinder block 104 using the first fastener 106 and the second fastener 108, the first fastener body 130 and the second fastener body 142 extend through the main cavity 144.

The first boss cylinder head cavity portion 123 and the second boss cylinder head cavity portion 135 each have lengths which are non-zero (e.g., not insubstantial, non-negligible, etc.) percentages of the length of the portion of the first boss 118 (e.g., a first boss cylinder head length, etc.) and the length of the portion of the second boss 120 (e.g., a second boss cylinder head length, etc.), respectively, that extends through the cylinder head 102. The length of the first boss cylinder head cavity portion 123 may be the same as, or different from, the length of the second boss cylinder head cavity portion 135. For example, the first boss cylinder head cavity portion 123 may constitute 5% of the length the portion of the first boss 118 that extends through the cylinder head 102 and the second boss cylinder head cavity portion 135 may constitute 5% of the length the portion of the second boss 120 that extends through the cylinder head 102. In another example, the first boss cylinder head cavity portion 123 may constitute at least 1% of the length the portion of the first boss 118 that extends through the cylinder head 102 and the second boss cylinder head cavity portion 135 may constitute at least 1% of the length the portion of the second boss 120 that extends through the cylinder head 102. In yet another example, the first boss cylinder head cavity portion 123 may constitute at least 5% of the length the portion of the first boss 118 that extends through the cylinder head 102 and the second boss cylinder head cavity portion 135 may constitute at least 3% of the length the portion of the second boss 120 that extends through the cylinder head 102.

The main cavity 144 is positioned proximate the cylinder head-block interface 110. In an example embodiment, the main cavity 144 is contained entirely in the cylinder head 102. However, in other embodiments, the main cavity 144 is contained entirely in the cylinder block 104. In various embodiments, the main cavity 144 is substantially centered on the cylinder head-block axis 117.

The shape and configuration of the main cavity 144 may direct pressure from the coupling of the cylinder head 102 to the cylinder block 104 to a target location along the cylinder head-block interface 110. For example, the main cavity 144 may direct pressure to a combustion seal portion of the gasket 112. As shown in FIG. 1, the pressure is directed from the first boss cylinder head conduit portion 122 and the second boss cylinder head conduit portion 134 towards a focal point 146. Due to the shape of the main cavity 144 about the cylinder head-block axis 117, the focal point 146 is located at a junction between the cylinder head-block axis 117 and the main cavity 144 at a location above the main cavity 144. In some embodiments, the main cavity 144 is substantially symmetric about the cylinder head-block axis 117 along at least portions of the length of the cylinder head 102. However, in other embodiments, the main cavity 144 is not substantially symmetric about the cylinder head-block axis 117 at any location along the length of the cylinder head 102.

By changing the configuration of the first boss cylinder head cavity portion 123 and the second boss cylinder head cavity portion 135 (e.g., by sculpting the cylinder head 102 and the cylinder block 104 during computer-aided design, etc.), such as by increasing the diameters or spacing thereof, or by changing the configuration of the main cavity 144, such as by increasing a volume of the main cavity 144 or by relocating at least a portion of the main cavity 144 to be closer to the top surface 132 and/or the cylinder head-block interface 110, an operator can cause more or less pressure to be applied to the gasket 112 (e.g., because the cylinder head-block interface 110 is smaller, etc.). By increasing the pressure applied to the gasket 112, leakage out of the gasket is mitigated or substantially eliminated. In this way, the internal combustion engine 100 may be more desirable than an internal combustion engine with constant diameter through holes for coupling a cylinder head to a cylinder block because less leakage from the gasket 112 can be obtained and therefore less servicing of the internal combustion engine 100 may be required than with an internal combustion engine with constant diameter through holes or greater performance may be obtained by the internal combustion engine 100 than an internal combustion engine with constant diameter through holes for the same leakage or service interval (e.g., time between servicing, etc.).

FIG. 1 also includes arrows depicting a portion pressure gradient from each of the first boss cylinder head conduit portion 122 and the second boss cylinder head conduit portion 134 to the focal point 146. The pressure is transferred to the cylinder head-block interface 110 differently depending on the location of the focal point 146. The location of the focal point 146 is a function of the shape, size, and configuration of the main cavity 144. Applying pressure to the gasket 112 at target locations may be desirable to enhance performance and/or longevity of the gasket 112. Accordingly, by sculpting the main cavity 144 differently, the focal point 146 may be located to direct pressure to the target locations of the gasket 112, thereby enhancing the performance of the gasket 112 and/or increasing the longevity of the gasket 112. The ability of an operator to direct pressure to target locations by changing the configuration of the various components of the cylinder head 102 is a function of the isolation between the first fastener 106 and the cylinder head 102 proximate the cylinder head-block interface 110 (e.g., due to the first boss cylinder head cavity portion 123 and/or the main cavity 144, etc.), the first fastener 106 and the cylinder block 104 proximate the cylinder head-block interface 110 (e.g., due to the first boss cylinder block cavity portion 124, etc.), the second fastener 108 and the cylinder head 102 proximate the cylinder head-block interface 110 (e.g., due to the second boss cylinder head cavity portion 135 and/or the main cavity 144, etc.), and the second fastener 108 and the cylinder block 104 proximate the cylinder head-block interface 110 (e.g., due to the second boss cylinder block cavity portion 136, etc.).

in effect, the differing diameter or spacing of the first boss 118 along the length of the first boss 118, and the different diameter or spacing of the second boss 120 along the length of the second boss 120, breaks a load path of least resistance which is present in holes having a constant diameter or spacing, such as those utilize to fastener cylinder heads to cylinder blocks in some internal combustion engines, by essentially 'short-circuiting' the load path. Due to the different diameters or spacing within each of the first boss 118 and the second boss 120, pressure is not able to be transmitted along the first boss 118 from the cylinder head 102 to the cylinder block 104 or along the second boss 120 from the cylinder head 102 to the cylinder block 104, and is insert diverted to the focal point 146.

The first boss cylinder block cavity portion 124 and the second boss cylinder block cavity portion 136 each have lengths which are non-zero percentages of the length of the portion of the first boss 118 (e.g., a first boss cylinder block length, etc.) and the length of the portion of the second boss 120 (e.g., a second boss cylinder block length, etc.), respectively, that extends through the cylinder block 104. The length of the first boss cylinder block cavity portion 124 may be the same as, or different from, the length of the second boss cylinder block cavity portion 136. For example, the first boss cylinder block cavity portion 124 may constitute 75% of the length the portion of the first boss 118 that extends through the cylinder block 104 and the second boss cylinder block cavity portion 136 may constitute 75% of the length the portion of the second boss 120 that extends through the cylinder block 104. In another example, the first boss cylinder block cavity portion 124 may constitute at least 30% of the length the portion of the first boss 118 that extends through the cylinder block 104 and the second boss cylinder block cavity portion 136 may constitute 30% of the length the portion of the second boss 120 that extends through the cylinder block 104. In yet another example, the first boss cylinder block cavity portion 124 may constitute at least 20% of the length the portion of the first boss 118 that extends through the cylinder block 104 and the second boss cylinder block cavity portion 136 may constitute 40% of the length the portion of the second boss 120 that extends through the cylinder block 104.

The cylinder head 102 also includes a drain 148. The cylinder head 102 may include one drain 148 or a plurality (e.g., two, three, six, etc.) of drains 148. The drains 148 may be located proximate the first side 114 and/or proximate the second side 116. The drain 148 extends from the top surface 132 towards the cylinder head-block interface 110. In various embodiments, the drain 148 is centered on an axis parallel to the cylinder head-block axis 117.

The drain 148 fluidly couples the top surface 132 to the main cavity 144. In this way, fluid (e.g., oil, gases, crankcase gases, air, etc.) from the top surface 132 may be routed (e.g., drained, evacuated, funneled, etc,) to the drain 148 (e.g., using gravity, etc.) such that the fluid is provided to the main cavity 144. Once in the main cavity 144, the fluid may be provided to the first boss cylinder head cavity portion 123, the first boss cylinder block cavity portion 124, the second boss cylinder head cavity portion 135, and/or the second boss cylinder block cavity portion 136 to route the fluid through the cylinder head 102 and/or the cylinder block 104 and into a drain gallery 150. The drain gallery 150 is in fluid communication with the drain 148, the main cavity 144, the first boss cylinder head cavity portion 123, the first boss cylinder block cavity portion 124, the second boss cylinder head cavity portion 135, and/or the second boss cylinder block cavity portion 136 for each adjacent pair of the first fastener 106 and the second fastener 108. In this way, the drain gallery 150 fluidly couples each adjacent first boss 118 and second boss 120. Additionally, the drain gallery 150 fluidly couples a first adjacent first boss 118 and second boss 120 to a second adjacent first boss 118 and second boss 120, thereby facilitating fluid communication between adjacent pairs of the first boss 118 and between adjacent pairs of the second boss 120 as well as between adjacent main cavities 144.

Figure 2:
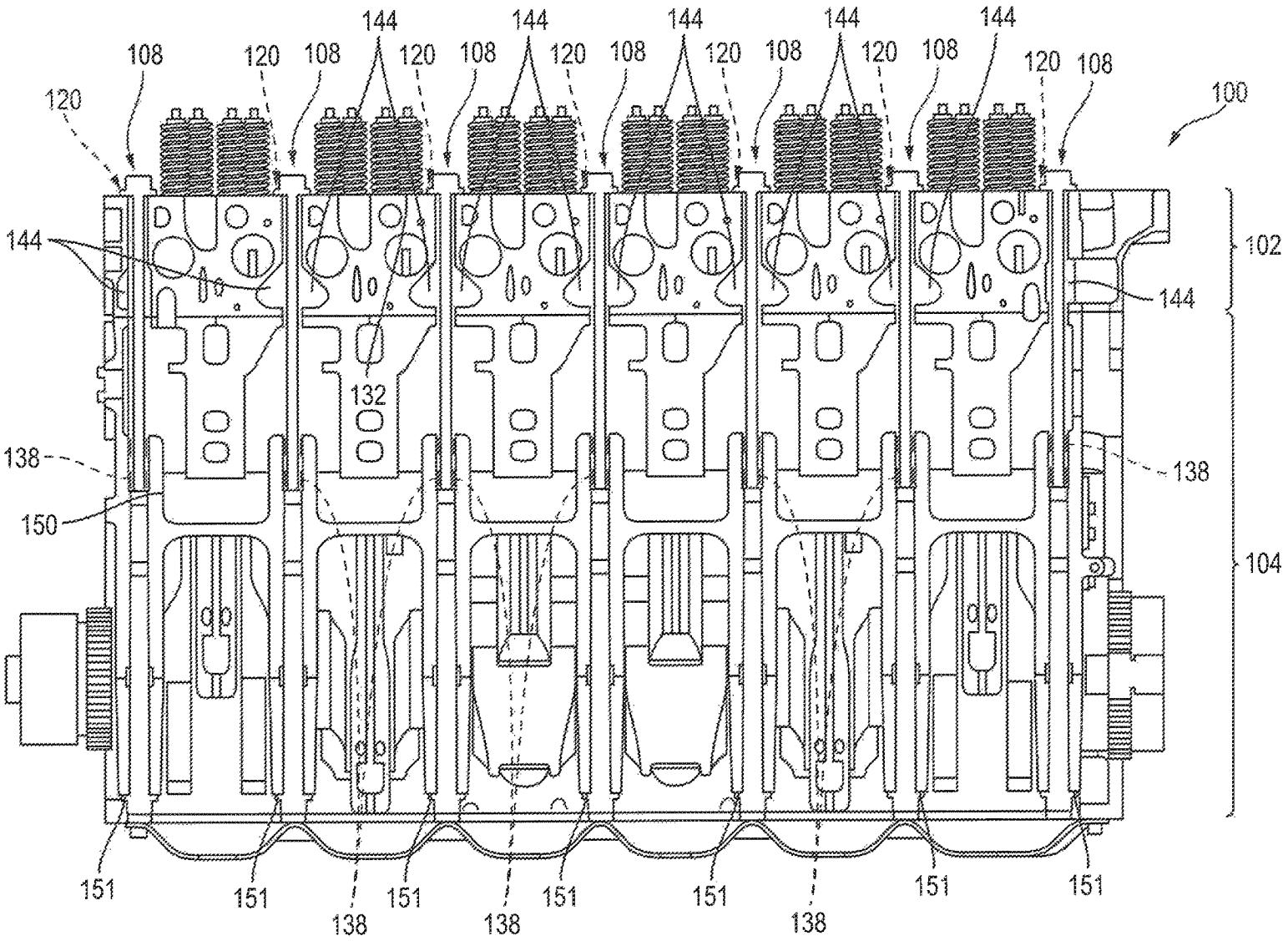
FIG. 2 is another cross-sectional view of a portion of the internal combustion engine shown in FIG. 1.

FIG. 2 illustrates a cross-sectional view of the internal combustion engine 100 taken along a plane extending through the second boss axis 121 along the length of the internal combustion engine 100. As shown in FIG. 2, the internal combustion engine 100 includes adjacent second fasteners 108, and therefore adjacent second bosses 120, disposed along the length of the internal combustion engine 100 (e.g., disposed at regular intervals along the length of the internal combustion engine 100, etc.).

FIG. 2 also illustrates the second fasteners 108 extending through the drain gallery 150 and the second boss cylinder block threaded portion 138 protruding into the drain gallery 150. Accordingly, the second boss cylinder block threaded portion 138 is structurally isolated from other portions of the cylinder block 104. This isolation facilitates directing of the load from the second fasteners 108 towards the focal point 146. While not shown in FIG. 2, it is understood that the other side of the internal combustion engine 100 (e.g., the first side 114, etc.) is similarly configured such that the first fasteners 106 extend through the drain gallery 150 and the first boss cylinder block threaded portions 126 protrude into the drain gallery 150 and are structurally isolated from other portions of the cylinder block 104 to facilitate directing of the load from the first fasteners 106 towards the focal point 146.

FIG. 2 also shows the second bosses 120 as extending from the top surface 132 of the cylinder head 102 to a bottom surface 151 of the cylinder block 104. It is understood that the first bosses 118 similarly extend from the top surface 132 of the cylinder head 102 to the bottom surface 151. In this way, the first bosses 118 and the second bosses 120 are through holes extending through both the cylinder head 102 and the cylinder block 104. Main bolts may utilize the first bosses 118 and/or the second bosses 120 proximate the bottom surface 151. It is understood that the internal combustion engine has a cross-sectional view similar to that shown in FIG. 2 when taken along a plane extending through the first boss axis 119 along the length of the internal combustion engine 100 and viewed from the first side 114.

Figure 3:
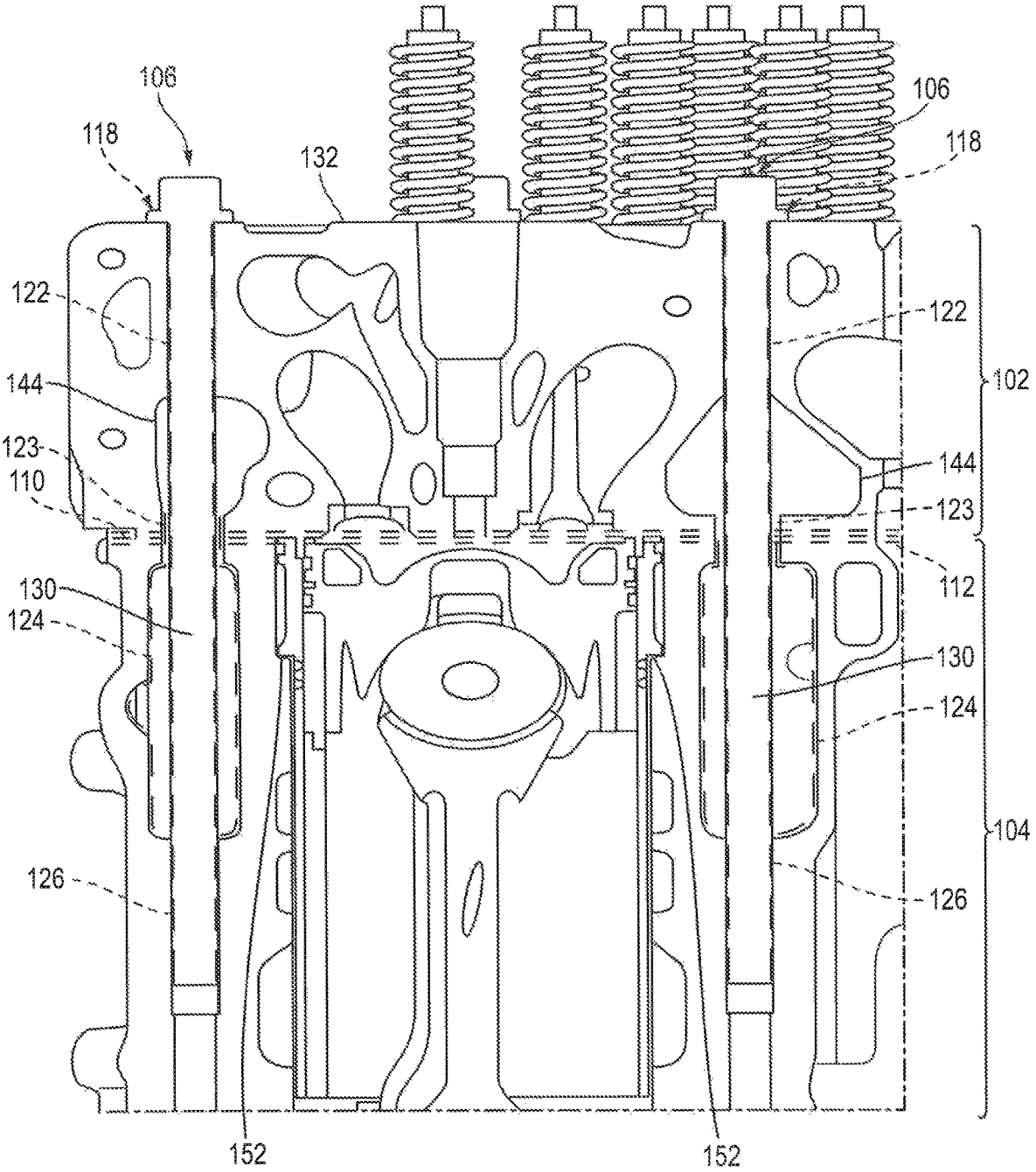
FIG. 3 is yet another cross-sectional view of a portion of the internal combustion engine shown in FIG. 1.

FIG. 3 illustrates a cross-sectional view of a portion of the internal combustion engine 100 taken along a plane extending through the cylinder head-block axis 117 along a portion of the length of the internal combustion engine 100 and viewed from the second side 116. As shown in FIG. 3, the first boss cylinder block cavity portion 124 extends below a linear seating surface 152 (e.g., relative to the top surface 132, etc.). In this way, the first fastener 106 may mitigate distortion of the cylinder head 102 (e.g., the first boss 118, etc.) and reduce fatigue of a midstop fillet within the cylinder block 104, therefore making the internal combustion engine 100 more desirable.

In one example, the drain gallery 150, the drain 148, the main cavity 144, the first boss cylinder head cavity portion 123, the first boss cylinder block cavity portion 124, the second boss cylinder head cavity portion 135, and the second boss cylinder block cavity portion 136 may be in fluid communication with an oil circulation system for the cylinder head 102 and the cylinder block 104.

Beneficially, the drain gallery 150, the drain 148, the main cavity 144, the first boss cylinder head cavity portion 123, the first boss cylinder block cavity portion 124, the second boss cylinder head cavity portion 135, and the second boss cylinder block cavity portion 136 may provide for additional fluid capacity within the internal combustion engine 100 (e.g., to store additional oil, etc.) compared to other engines which do not include the first boss 118 or the second boss 120. In this way, the internal combustion engine 100 may utilize smaller fluid reservoirs (e.g., oil reservoirs, etc.), thereby reducing the physical footprint and cost of the internal combustion engine 100. It is understood that the internal combustion engine has a cross-sectional view similar to that shown in FIG. 3 when taken along a plane extending through the cylinder head-block axis 117 along a portion of the length of the internal combustion engine 100 and viewed from the first side 114.

Figure 4:
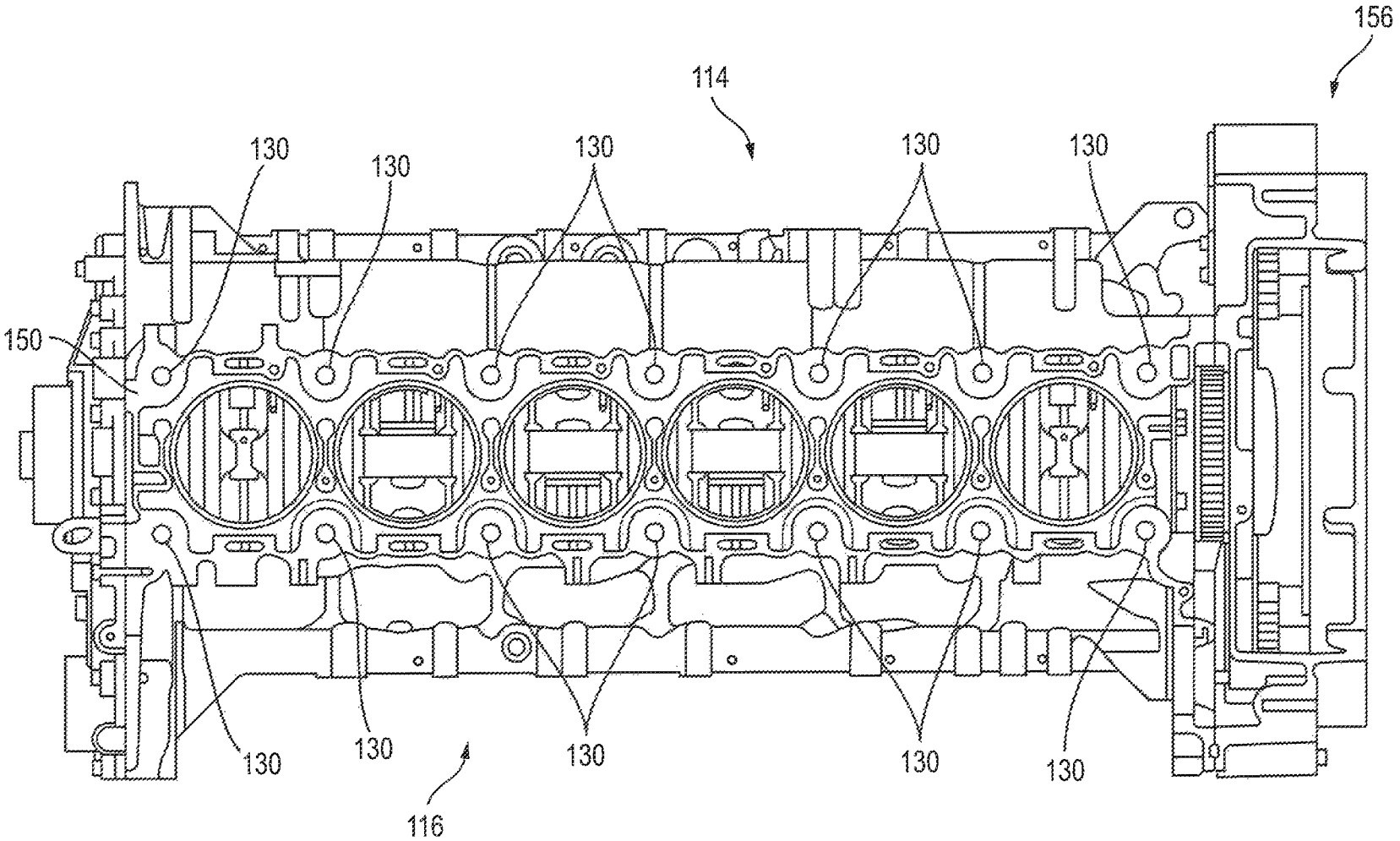
FIG. 4 is yet another cross-sectional view of a portion of the internal combustion engine shown in FIG. 1.

FIG. 4 illustrates a cross-sectional view of the internal combustion engine along a plane parallel to the cylinder head-block interface 110. The internal combustion engine 100 including a crankcase 156 (e.g., a housing for a crankshaft of the internal combustion engine 100, etc). The crankcase 156 is mounted to an end of the cylinder head 102 and/or cylinder block 104 (e.g., depending on orientation of the internal combustion engine 100, etc.). The drain gallery 150 provides the fluid to the crankcase 156.

While not shown in FIGS. 1-4, it is understood that the internal combustion engine 100 includes at least one main bolt (e.g., cylinder head main bolt, etc.) which is separate from the first fastener 106 and the second fastener 108 and which threadably engages with the cylinder block 104. Various components (e.g., main caps, main bearings, crankshaft, etc.) of the internal combustion engine 100 may be coupled to the cylinder block 104 through the main bolts. The main bolt may share the same axis as the first fastener 106 and/or the second fastener 108 to facilitate cost effective and robust manufacturing of the internal combustion engine 100. In this way, the internal combustion engine 100 may be configured with a main bolt that is concentric with the first fastener 106 and/or the second fastener 108.

In various embodiments, each of the cylinder head 102, the cylinder block 104, the first fastener 106, and the second fastener 108 are constructed from aluminum, iron, steel, titanium, alloys, composites (e.g., aluminum composites, steel composites, etc.), combinations thereof, and other similar metals.

III. Construction of Example Embodiments

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the terms "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "attached," "fastened," and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

The term "in fluid communication with" and the like, as used herein, mean the two components or objects have a pathway formed between the two components or objects in which a fluid, such as air, oil, fuel, liquid reductant, gaseous reductant, aqueous reductant, gaseous ammonia, etc., may flow, either with or without intervening components or objects. Examples of fluid couplings or configurations for enabling fluid communication may include piping, channels, or any other suitable components for enabling the flow of a fluid from one component or object to another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the application, the scope being defined by the claims that follow. When the language "a portion" is used, the item can include a portion and/or the entire item unless specifically stated to the contrary. Also, the term "or" is used in its inclusive sense (and not in its exclusive sense) so that when used, for example, to connect a list of elements, the term "or" means one, some, or all of the elements in the list.

What is claimed is:

1. An internal combustion engine comprising:

a cylinder head defined by an exhaust side and an intake side opposite the exhaust side, the cylinder head comprising:

a first boss cylinder head conduit portion disposed proximate the exhaust side and configured to receive a first fastener without threadably engaging the first fastener, the first boss cylinder head conduit portion having a first diameter;

a first boss cylinder head cavity portion aligned with the first boss cylinder head conduit portion and configured to receive the first fastener without threadably engaging the first fastener, the first boss cylinder head cavity portion having a first spacing greater than the first diameter;

a second boss cylinder head conduit portion disposed proximate the intake side and configured to receive a second fastener without threadably engaging the second fastener, the second boss cylinder head conduit portion having a second diameter; and a second boss cylinder head cavity portion aligned with the second boss cylinder head conduit portion and configured to receive the second fastener without threadably engaging the second fastener, the second boss cylinder head cavity portion having a second spacing greater than the second diameter;

a cylinder block coupled to the cylinder head, the cylinder block comprising a first boss cylinder block threaded portion aligned with the first boss cylinder head conduit portion, the first boss cylinder block threaded portion configured to threadably engage the first fastener;

wherein the first fastener does not threadably engage the cylinder head when: the first fastener is received in the first boss cylinder head cavity portion, the first fastener is received in the first boss cylinder head cavity portion, and the first fastener is threadably engaged with the first boss cylinder block threaded portion.

2. The internal combustion engine of claim 1, wherein the cylinder block further comprises a second boss cylinder block threaded portion aligned with the second boss cylinder head conduit portion, the second boss cylinder block threaded portion configured to threadably engage the second fastener.

3. The internal combustion engine of claim 2, wherein the cylinder block further comprises a first boss cylinder block cavity portion aligned with the first boss cylinder head conduit portion, the first boss cylinder block cavity portion configured to receive the first fastener without threadably engaging the first fastener.

4. The internal combustion engine of claim 3, wherein:

a cylinder head-block interface is defined between the cylinder head and the cylinder block;

the first boss cylinder head cavity portion is contiguous with the cylinder head-block interface; and the second boss cylinder head cavity portion is contiguous with the cylinder head-block interface.

5. The internal combustion engine of claim 4, wherein:

the first boss cylinder block cavity portion is contiguous with the cylinder head-block interface; and the second boss cylinder block cavity portion is contiguous with the cylinder head-block interface.

6. The internal combustion engine of claim 1, wherein the cylinder block further comprises a first boss cylinder block cavity portion aligned with the first boss cylinder head conduit portion, the first boss cylinder block cavity portion configured to receive the first fastener without threadably engaging the first fastener.

7. The internal combustion engine of claim 6, wherein:

a cylinder head-block interface is defined between the cylinder head and the cylinder block;

the first boss cylinder head cavity portion is contiguous with the cylinder head-block interface; and the first boss cylinder block cavity portion is contiguous with the cylinder head-block interface.

8. The internal combustion engine of claim 1, wherein the cylinder head further comprises a main cavity contiguous with the first boss cylinder head conduit portion and the first boss cylinder head cavity portion, the main cavity configured to receive the first fastener without threadably engaging the first fastener, the main cavity separating the first boss cylinder head conduit portion from the first boss cylinder head cavity portion.

9. The internal combustion engine of claim 1, wherein:

the first boss cylinder head cavity portion is non-circular; and the second boss cylinder head cavity portion is non-circular.

10. An internal combustion engine comprising:

a cylinder head defined by an intake side and an exhaust side, the cylinder head comprising:

a first boss cylinder head conduit portion centered on a first boss axis, the first boss cylinder head conduit portion separated from the first boss axis by a first spacing;

a first boss cylinder head cavity portion aligned with the first boss cylinder head conduit portion, the first boss cylinder head cavity portion separated from the first boss axis by a second spacing greater than the first spacing;

a second boss cylinder head conduit portion centered on a second boss axis, the second boss cylinder head conduit portion separated from the second boss axis by a third spacing; and a second boss cylinder head cavity portion aligned with the second boss cylinder head conduit portion, the second boss cylinder head cavity portion separated from the second boss axis by a fourth spacing greater than the third spacing;

a cylinder block coupled to the cylinder head, the cylinder block comprising:

a first boss cylinder block cavity portion aligned with the first boss cylinder head conduit portion, the first boss cylinder block cavity portion separated from the first boss axis by the second spacing; and a first boss cylinder block threaded portion aligned with the first boss cylinder head conduit portion, the first boss cylinder block threaded portion separated from the first boss axis by a fifth spacing less than the second spacing; and a first fastener received within the first boss cylinder head conduit portion, the first boss cylinder head cavity portion, the first boss cylinder block cavity portion, and the first boss cylinder block threaded portion, the first fastener engaging the first boss cylinder block threaded portion, the first fastener not engaging the first boss cylinder head conduit portion, the first boss cylinder head cavity portion, or the first boss cylinder block cavity portion;

a second fastener received within the second boss cylinder head conduit portion and the second boss cylinder head cavity portion, the second fastener not engaging the second boss cylinder head conduit portion or the second boss cylinder head cavity portion;

wherein the first boss cylinder head conduit portion is disposed between the intake side and the second boss cylinder head conduit portion; and wherein the second boss cylinder head conduit portion is disposed between the exhaust side and the first boss cylinder head conduit portion.

11. The internal combustion engine of claim 10, wherein the cylinder block further comprises:

a second boss cylinder block cavity portion aligned with the second boss cylinder head conduit portion, the second boss cylinder block cavity portion separated from the second boss axis by the fifth spacing; and a second boss cylinder block threaded portion aligned with the second boss cylinder head conduit portion, the second boss cylinder block threaded portion separated from the second boss axis by a sixth spacing less than the fifth spacing; and the second fastener is additionally received the second boss cylinder block threaded portion and the second boss cylinder block cavity portion, the second fastener engaging the second boss cylinder block threaded portion, the second fastener not engaging the second boss cylinder block cavity portion.

12. The internal combustion engine of claim 11, wherein:

a cylinder head-block interface is defined between the cylinder head and the cylinder block;

the first boss cylinder head cavity portion is contiguous with the cylinder head-block interface; and the second boss cylinder head cavity portion is contiguous with the cylinder head-block interface.

13. The internal combustion engine of claim 12, wherein:

the first boss cylinder block cavity portion is contiguous with the cylinder head-block interface; and the second boss cylinder block cavity portion is contiguous with the cylinder head-block interface.

14. The internal combustion engine of claim 10, wherein:

a cylinder head-block interface is defined between the cylinder head and the cylinder block;

the first boss cylinder head cavity portion is contiguous with the cylinder head-block interface; and the first boss cylinder block cavity portion is contiguous with the cylinder head-block interface.

15. The internal combustion engine of claim 14, wherein:

the cylinder head further comprises a main cavity contiguous with the first boss cylinder head conduit portion and the first boss cylinder head cavity portion;

the first fastener is received within the main cavity without threadably engaging the main cavity; and the main cavity separates the first boss cylinder head conduit portion from the first boss cylinder head cavity portion.

16. An internal combustion engine comprising:

a cylinder head having an exhaust side and an intake side opposite the exhaust side, the cylinder head comprising:

a first boss cylinder head conduit portion configured to receive a first fastener without threadably engaging the first fastener, the first boss cylinder head conduit portion centered on a first boss axis and separated from the first boss axis by a first spacing;

a first boss cylinder head cavity portion aligned with the first boss cylinder head conduit portion, the first boss cylinder head cavity portion configured to receive the first fastener without threadably engaging the first fastener, the first boss cylinder head cavity portion separated from the first boss axis by a second spacing greater than the first spacing;

a second boss cylinder head conduit portion located between the first boss cylinder head conduit portion and the intake side and configured to receive a second fastener without threadably engaging the second fastener, the second boss cylinder head conduit portion centered on a second boss axis and separated from the second boss axis by a third spacing; and a second boss cylinder head cavity portion aligned with the second boss cylinder head conduit portion, the second boss cylinder head cavity portion configured to receive the second fastener without threadably engaging the second fastener, the second boss cylinder head cavity portion separated from the second boss axis by a fourth spacing greater than the third spacing; and a cylinder block coupled to the cylinder head, the cylinder block comprising:

a first boss cylinder block cavity portion aligned with the first boss cylinder head conduit portion, the first boss cylinder block cavity portion configured to receive the first fastener without threadably engaging the first fastener, the first boss cylinder block cavity portion separated from the first boss axis by the second spacing;

a first boss cylinder block threaded portion aligned with the first boss cylinder head conduit portion, the first boss cylinder block threaded portion configured to receive and threadably engage the first fastener, the first boss cylinder block threaded portion separated from the first boss axis by a fifth spacing less than the second spacing;

a second boss cylinder block cavity portion aligned with the second boss cylinder head conduit portion, the second boss cylinder block cavity portion configured to receive the second fastener without threadably engaging the second fastener, the second boss cylinder block cavity portion separated from the second boss axis by the fourth spacing; and a second boss cylinder block threaded portion aligned with the second boss cylinder head conduit portion, the second boss cylinder block threaded portion configured to receive and threadably engage the second fastener, the second boss cylinder block threaded portion separated from the second boss axis by a sixth spacing less than the fourth spacing;

wherein a cylinder head-block interface is defined between the cylinder head and the cylinder block;

wherein the first boss cylinder head cavity portion is contiguous with the cylinder head-block interface;

wherein the first boss cylinder block cavity portion is contiguous with the cylinder head-block interface; and wherein the first boss cylinder head conduit portion is located between the exhaust side and the second boss cylinder head conduit portion.

17. The internal combustion engine of claim 16, wherein:

the second boss cylinder head cavity portion is contiguous with the cylinder head-block interface; and the second boss cylinder block cavity portion is contiguous with the cylinder head-block interface.

18. The internal combustion engine of claim 16, wherein:

the cylinder head further comprises a main cavity contiguous with the first boss cylinder head conduit portion, the first boss cylinder head cavity portion, the second boss cylinder head conduit portion, and the second boss cylinder head cavity portion;

the first fastener is received within the main cavity without threadably engaging the main cavity;

the second fastener is received within the main cavity without threadably engaging the main cavity;

the main cavity separates the first boss cylinder head conduit portion from the first boss cylinder head cavity portion; and the main cavity separates the second boss cylinder head conduit portion from the second boss cylinder head cavity portion.

19. The internal combustion engine of claim 18, wherein:

the first boss cylinder head conduit portion is centered on a first boss axis;

the second boss cylinder head conduit portion is centered on a second boss axis; and the first boss axis is parallel to the second boss axis.

20. The internal combustion engine of claim 19, wherein:

the main cavity is centered on a cylinder head-block axis; and the first boss axis and the second boss axis are substantially equidistant from the cylinder head-block axis.

21. A cylinder head defined by an exhaust side and an intake side opposite the exhaust side, the cylinder head comprising:

a first boss cylinder head conduit portion disposed proximate the exhaust side and between the intake side and the exhaust side, the first boss cylinder head conduit portion configured to receive a first fastener without threadably engaging the first fastener and to maintain a first spacing from the first fastener when the first fastener is received in the first boss cylinder head conduit portion;

a first boss cylinder head cavity portion aligned with the first boss cylinder head conduit portion and configured to receive the first fastener without threadably engaging the first fastener, the first boss cylinder head cavity portion configured to maintain a second spacing from the first fastener when the first fastener is received in the first boss cylinder head cavity portion, the second spacing greater than the first spacing; and a second boss cylinder head conduit portion disposed proximate the intake side and between the first boss cylinder head conduit portion and the intake side, the second boss cylinder head conduit portion configured to receive a second fastener;

wherein the first boss cylinder head conduit portion is contiguous with a top surface of the cylinder head configured to interface with the first fastener when the first fastener is received in the first boss cylinder head conduit portion.

22. The cylinder head of claim 21, wherein the first boss cylinder head cavity portion is contiguous with a cylinder head-block interface from which the first fastener is configured to protrude when the first fastener is received in the first boss cylinder head conduit portion.

23. The cylinder head of claim 22, further comprising a main cavity contiguous with the first boss cylinder head conduit portion and the first boss cylinder head cavity portion, the main cavity configured to receive the first fastener without threadably engaging the first fastener.

24. The cylinder head of claim 21, wherein:

the first boss cylinder head cavity portion and the first boss cylinder head conduit portion constitute portions of a first boss defined by a first boss cylinder head length;

the first boss cylinder head cavity portion constitutes at least 1% of the first boss cylinder head length.

25. A cylinder block comprising:

a first boss cylinder block threaded portion configured to receive and threadably engage a first fastener;

a first boss cylinder block cavity portion aligned with the first boss cylinder block threaded portion and configured to receive the first fastener without interfacing with the first fastener, the first boss cylinder block cavity portion contiguous with a cylinder head-block interface from which the first fastener is configured to protrude when the first fastener is received in the first boss cylinder block threaded portion;

a second boss cylinder block threaded portion configured to receive and threadably engage a second fastener;

a second boss cylinder block cavity portion aligned with the second boss cylinder block threaded portion and configured to receive the second fastener without interfacing with the second fastener, the second boss cylinder block cavity portion contiguous with the cylinder head-block interface from which the second fastener is configured to protrude when the second fastener is received in the second boss cylinder block threaded portion; and a drain gallery contiguous with the first boss cylinder block cavity portion and the second boss cylinder block cavity portion, the drain gallery configured to contain a fluid within the cylinder block.

26. The cylinder block of claim 25, wherein the first fastener is at least partially surrounded by the fluid in the first boss cylinder block cavity portion when the first fastener is received within the first boss cylinder block threaded portion.

27. The cylinder block of claim 26, further comprising a linear seating surface positioned closer to the cylinder head-block interface than a border between the first boss cylinder block cavity portion and the first boss cylinder block threaded portion.

* * * * *